United States Patent [19]

Fujiwhara et al.

[11] Patent Number: 4,690,888

[45] Date of Patent: Sep. 1, 1987

[54] SILVER HALIDE COLOR PHOTO-SENSITIVE MATERIAL

[75] Inventors: Mitsuto Fujiwhara; Takao Nimura; Yasumasa Numata; Yasuko Matsubara, all of Hino, Japan

[73] Assignee: Konishiroku Photo Industry Co., Ltd., Tokyo, Japan

[21] Appl. No.: 774,340

[22] Filed: Sep. 10, 1985

[30] Foreign Application Priority Data

Sep. 14, 1984 [JP] Japan ..... 59-195152

[51] Int. Cl.[4] ..... G03C 1/40; G03C 7/32

[52] U.S. Cl. ..... 430/549; 430/359; 430/504; 430/543

[58] Field of Search ..... 430/226, 359, 549, 504, 430/365, 543

[56] References Cited

U.S. PATENT DOCUMENTS

| | | | |
|---|---|---|---|
| 3,615,225 | 10/1971 | Otto et al. | 430/359 |
| 4,026,573 | 9/1977 | Inouye et al. | 430/226 |
| 4,029,503 | 6/1977 | Fujiwhara et al. | 430/226 |
| 4,156,608 | 5/1979 | Vetter et al. | 430/359 |
| 4,420,556 | 12/1983 | Booms et al. | 430/549 |
| 4,567,135 | 1/1986 | Arakawa et al. | 430/549 |

*Primary Examiner*—Richard L. Schilling

*Attorney, Agent, or Firm*—Jordan B. Bierman

[57] ABSTRACT

A photosensitive silver halide colored photographic material having (1) ballasted couplers combined with photosensitive silver halide emulsions and (2) colored compounds capable of reacting with oxidized developing agent, wherein the colored compounds are capable of diffusing in the photographic material during developing treatments and have their principal absorption in the main absorption wavelength region of the dye produced by the reaction of the coupler with the developing agent.

10 Claims, No Drawings

SILVER HALIDE COLOR PHOTO-SENSITIVE MATERIAL

BACKGROUND OF THE INVENTION

This invention relates to a silver halide color photo-sensitive material (hereinafter referred to as photographic material), and more particularly to a photographic material which can automatically form a color image and an unsharp mask.

As a photographic material which can form a color image and unsharp mask in order to secure a color image excellent in sharpness, French Pat. No. 2,260,124 has disclosed a photographic material which was made by orderly laminating a physical developing nuclei-containing layer which contains a ballasted coupler, a layer which contains a scavenger for the oxidized of color-developing agents, and a photo-sensitive silver halide emulsion layer which contains a ballasted coupler. Therein is disclosed a method that, a color negative image is obtained by exposing and color-developing using a first color developer which does not contain any silver halide solvent, and then the unsharp positive image is obtained by physical color-development using a second color developer which contains a silver halide solvent, as a method desirable to obtain a color negative image and an unsharp positive image using said photographic material.

However for such a photographic material, it is necessary to make a color-developing reaction occur in exposed areas in order to obtain the color negative image, and to make a physically color-developing reaction occur using dissolved silver halide in unexposed areas in order to obtain the unsharp positive image. Therefore, it is essential to make the scavenger for oxidized color developing agents, present between two layers which contain ballasted couplers in order to prevent dispersion of oxidized color-developing agents, which are produced when the color negative image is formed, into the physically color-developing nuclei-containing layer.

In other words, the absence of such a scavenger would cause part of the oxidized color-developing agents, which are produced in the exposure areas, to disperse into the physically color-developing nuclei-containing layers, and, consequently, would cause an unsharp negative image to form therein by color-developing reaction, resulting in failure to obtain both color negative and unsharp positive images as desired. In addition, the absence of the scavenger would make it difficult to improve the image sharpness because of its difficulty to make the material thinner due to the essentiality of the three layers including said scavenger-containing layer.

Furthermore, according to this method, it is necessary to conduct color-development twice using different two color-developers. If one and only development were conducted using only the silver halide solvent-containing developer, it would make it infeasible to control either the color development procedure for obtaining the color negative image, or the formation of silver halide complex for supplying silver ions to the physically developing nuclei-containing layer. When such controls are unsuccessful, and the complex is formed in excess, the formation of the color negative image becomes poor, and, correspondingly, the excessive dispersing of the complex into the physically developing nuclei-containing layer, resulting in the formation of unsharp positive image in areas where the color negative image should be properly formed. Thus the purpose of obtaining color negative and unsharp mask images as desired would not be attained.

This invention aims at resolving drawbacks of the prior art as described above.

It is accordingly an object of the invention to provide a photographic material which gives an image improved in sharpness by forming both color negative and unsharp positive images.

Another object of the invention is to provide a photographic material which gives very sharp images with a fewer number of essential layers.

A further object of the invention is to provide a photographic material which can form both color negative and unsharp positive images of good quality through the only one developing process.

SUMMARY OF THE INVENTION

As a result of intensive studies by inventors, they found the above-mentioned purposes were attained by a photographic material which had such constituents as described below.

The photographic material of the invention is a silver halide color photo-sensitive material having both of ballasted couplers combined with photo-sensitive silver halide emulsions, and colored compounds to be reacted with oxidized developing agents, and is characterized in that said colored compounds are compounds capable of slightly diffusing in said photographic material during developing treatments.

In the invention, to diffuse during developing treatments means that, during the picture-making processes, preferably a developing process, said colored compound diffuses by 1 μm or more, preferably by 5 μm or more, but at least 30 wt% of its used amount remains in the photographic material still after developing treatments.

DETAILED DESCRIPTION OF THE INVENTION

Further detailed description of the invention is given as follows:

First, the compound which is a colored compound that reacts with the oxidized developing agent, and is capable of slightly diffusing in the photographic material during developing treatments is described. Hereinafter it is referred to as the compound of the invention.

The compound of the invention is a colored compound which has its primary absorption in the primary absorption region of the dye that is produced by the reaction between the above-mentioned ballasted coupler and the oxidized color developing agent. The compound of the invention forms a colored or colorless product by the reaction with the oxidized developing agents. And when the reaction product has a color tone undesirable in view of the image formation, the reaction product diffuses out of the photographic material. Hence in areas where color images are produced by the reaction between the oxidized color developing agent and the ballasted coupler, the compound of the invention also reacts with the oxidized developing agent to form the reaction product which either is noncolored, or colored but diffusible out of the photographic material. In areas where color images are not produced from the ballasted coupler, the compound of the invention remains not to react but diffuses slightly. Consequently, the compound of the invention forms color images opposite to those from said ballasted coupler; the former are positive images when the latter are negative images, for example. In addition the compound of the invention forms unsharp images, namely unsharp mask images because of its dispersibility.

As the compound of the invention, for example, compounds expressed by the following General Formula [1] are cited.

A—Link—B General Formula [1]

Where A is an organic residue which releases the component of Link-B on reacting with the oxidized developing agent corresponding to the amount of the oxidized developing agent. B is another organic residue, and Link is a group which links A and B groups together.

A compound expressed by General Formula [1] is a colored compound which is capable of slightly diffusing in the photographic material during developing treatments. The compound is equipped with substituent group(s) which balance between hydrophilic and lipophilic properties so that its reaction product may diffuse out of the material system after the reaction, provided that any product from A or Link-B group could constitute any compound which presents undersirable color tone in view of the image formation.

As the A group in General Formula [1], there are cited either residues of couplers which form colored or noncolored products through coupling reaction with oxidized color developing agents, or components which are submitted to cross-oxidation reactions with oxidized developing agents.

As concrete samples for the former, there are cited residues of compounds including, for example, phenols, naphthols, 5-pyrazolones, pyrazolotriazoles, pyrazolobenzimidazoles, indazolones, acylacetanilides; compounds expressed by $RCOCH_3$, where R is, for example, an alkyl, aryl or heterocyclic group; and compounds expressed by:

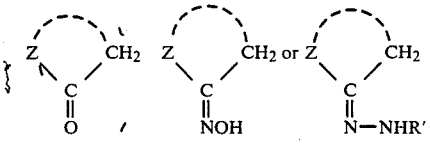

Where Z is, for example, a group of atoms which constitute a 5- to 8-member saturated or unsaturated, alicyclic or heterocyclic group, and R′ is an aryl residue.

As concrete samples for the latter, there are cited residues of phenols, naphthols, indanones, indoles and hydroquinones, which all, after being oxidized by, for example, the oxidized developing agents, are submitted to an alkali-cleavage reaction to release $B—SO_2NH^{\ominus}$ as Link-B, and phenols which, after being oxidized by, for example, the oxidized developing agents, are submitted to an intramolecular ring-closing reaction to release $B—SO_2^{\ominus}$ as Link-B (Their details are described in U.S. Pat. Nos. 3,443,949, 3,443,940 and 3,443,941.), for example.

As Link groups, there are cited, for example, —N=N—, —O—, —S—, —NH—$SO_2$—, —$SO_2$—NH—, —CH=,

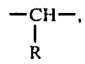

and groups expressed by:

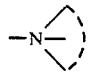

Where

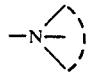

is a nitrogen-containing heterocyclic residue such as succinic imidoyl, phthalic imidoyl, pyridoyl, imidazolyl, imidazolonyl, benzimidazolyl, hydantoyl, thiohydantoyl, triazolyl, benzotriazolyl, urazolyl, 2,4-dioxyoxazolyl, 2,4-dioxothiazolyl, thiadiazolyl, or tetrazolyl; R is a group such as alkyl or aryl group which may be allowed to have substituent group(s).

The B group is an organic residue, for example, an aryl or heterocyclic group, which may be allowed to have auxochrome(s), or a dye residue, when the Link group is a chromophore such as —N=N— or —CH=. It is preferably a residue of dye such as azo, anthraquinone, azomethine, indophenol or indoaniline dye, when the Link is not a chromophore. A compound which is expressed by General Formula [I], and has such a constitution as above can be a colored substance owing to its B group or A-Link-B as a whole.

In order that a compound expressed by General Formula [I] may be provide with a property to slightly diffuse during developing treatments, and with a diffusibility to cause undesirable reaction products in case of the products is produced, to diffuse out of the material, such an alkali-soluble group as carboxyl, sulfo, hydroxyl or sulfamoyl group, and such a diffusibility-reducing group as alkyl group may be properly introduced to balance its diffusibilities before and after the reaction.

The compounds of the invention are classified into the following types, for example, according to their properties.

CLASS I: Chromophoric Dye-Forming Type

In a compound which belongs to this class, its A part of General Formula [I] is a coupler residue, and its Link group combines with the active site of the coupler. When the Link is —$NHSO_2$— (Whose nitrogen atom combines with the Coup group mentioned later), it may combine with a site adjacent to the active site.

Such a compound has preferably both alkali-soluble group(s) and an organic residue, such as alkyl group(s) with, for example, 16 or less carbon atom so as to exhibit slight diffusibility in the photographic material. When the dye which is formed by coupling of the A part with the oxidized color developing agent is undesirable in view of the image formation, it is preferable either that alkali-soluble group(s) are contained by the A group, or that a color developing agent having alkali-soluble group(s) is employed, so that said dye may diffuse out of the material during developing treatments.

When the B group forms a dye, it is preferable that alkali-soluble group(s) are contained by the B group, so that the B groups after reaction may diffuse out of the material.

In a compound which belongs to this class, its A group forms a negative dye image in the exposed areas, but diffuses out of the material, and, when its B group is a dye, the B group also is split from the A group to diffuse out of the material; consequently, positive images are formed by the compound expressed by General Formula [I] which remains in the unexposed areas. In addition, such a compound slightly moves in the layer during developing treatments of form unsharp positive images because of its diffusibility. Among this class, the following two types are especially preferable.

Type A: Colored Coupler Type

Coup—$Link_2$—Ar General Formula [II]

The Coup group of General Formula [II] is a coupler residue, preferably having alkali-soluble group(s), and the dye produced there from by color development diffuses out of the photographic material.

The Ar group is preferably an aryl group such as benzenoid or naphthlenoid group, allowably having substituent group(s), or a heterocyclic group such as isooxazole group, allowably having substituent group(s), and in addition, preferably has semi-ballasted group(s), so that said compound of General Formula (II) may slightly move in the photographic material. The $Link_2$ Group is —N=N— or —CH=. Some compounds of this Type A have been already as the colored coupler known by U.S. Pat. Nos. 2,449,969, 2,688,538, 2,706,684, 2,808,329 and 3,005,712; Belgian Pat. No. 570,271, and Japanese Patent Examined Publication No. 32461/1969, for example.

The invention is however altogether different from these prior arts not only in applying methods but also in applying purposes, and, consequently, in achieved effects. Since, in the above prior arts, the hue, which is exhibited by the dye produced from the coupler on reaction with the oxidized color developing agents, is the primary absorption for image formation, the dye there-from does not move in principle, and the hue exhibited by the colored coupler itself is due to a secondary absorption different from said primary absorption region. Whereas in this invention, the dye produced from the Coup group essentially diffuses out of the material, and so the hue exhibited by the compound of General Formula [II] is necessarily identical with the primary absorption of the color image. Thus, the photosensitive region of the silver halide layer combined with the compound of the invention is complementary to the hue from the compound of the invention in a case of a conventional negative photographic material, for example. More concretely, as for green-sensitive negative silver halide emulsion layer for example, a yellow compound is employed as a colored coupler in said prior art, while a magenta compound is employed in the invention. This difference will be easier understood by further description according to Example later.

Type B: Active Site Substitution Type

Coup—$Link_3$—Dye General Formula [III]

The Coup group of General Formula [III] is the same as that of General Formula [II]. The $Link_3$ also is synonymous with the Link of General Formula [I], and preferably a group such as —O—, —$SO_2$—NH—, or —NH-$SO_2$— which becomes alkali-soluble after coupling reaction. The Dye is a dye part, and preferably has alkali-soluble group(s), which are not always essential according to the type of the $Link_3$. The compound of General Formula [III] preferably has semi-ballasted group(s) so that it may slightly diffuse in the photographic material.

Said semi-ballasted group(s) are preferably attached to the group more diffusible between the dye produced on color development and the $Link_3$-Dye group. Although some compounds which belong to this type have been disclosed in U.S. Pat. Nos. 3,227,550 and 3,476,563 for example, these prior arts also are altogether different from the invention in applying methods as the case of the above Type A, and never include the conception of the invention. That is, although the above arts are used in the two cases, one for color correction of colored coupler as the case of the Type A, and the other for image formation by the Dye part which is diffused out and transferred; any way, they are clearly different from the mode of the invention.

Second, a group of compounds which do not exhibit color images after color developing are described.

CLASS II: Colorless Coupling compound Forming Type

Although a compound which belongs to this class has an A group which reacts with the oxidized developing agent in the way similar to a compound of CLASS I, the reaction product therefrom is allowed to remain in the layer even after coupling reaction because it is colorless.

Type C: White Coupler Type

W coup—$Link_4$—Dye General Formula [IV]

The W coup of General Formula [IV] is, for example, a residue expressed by $R_2COCH_2$—, where $R_2$ is a group such as alkyl, aryl or heterocyclic group with 16 or less carbon atoms; or by the following formula:

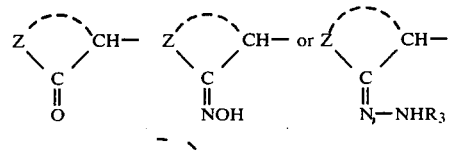

where Z is a group of atoms which constitute a 5- to 8-member alicyclic, condensed-ring or heterocyclic residue, and $R_3$ is an aryl residue, The $Link_4$ is —O—, —S—, or —$SO_2$—.

The Dye is a dye residue, preferably having alkali-soluble group(s). The $Link_4$-Dye diffuses out of the photographic material.

Furthermore, such a compound preferably has semi-ballasted group(s) which cooperate with alkali-soluble group(s) that may be attached to the Dye part, so that said compound itself may slightly move in the layer; it is especially preferable that said compound has said semi-ballasted group(s) in its W coup part.

CLASS III: Redox Reaction Type

A compound which belongs to this class is not submitted to any coupling reaction dissimilarly to the compound of CLASS I or II. Instead, it reacts with the oxidized developing agent to produce the oxidation product such as a quinone or quinoneimide compound which, in turn, releases the dye only by an reaction with alkali in the developer, or an intramolecular ring-closing reaction.

Type D: DRR Compound Type

FUN—$Link_5$—Dye General Formula [V]

The FUN group of General Formula [V] is preferably a redox compound moiety such as 2-, 3-, or 4-phenol; 4-α-naphthol, 1-β-naphthol, 2-hydroquinone, 3-indole, or 4-pyrazolone-5 residue; the $Link_5$ group is —$NHSO_2$— (where the nitrogen atom is combined with the Fun part), —O—, —$SO_2$—, or —S—; the Dye group is preferably a dye residue, and has alkali-soluble group(s).

Semi-ballasted group(s) which, if necessary, may cooperate with alkali-soluble group(s) that may be attached to the Dye part are preferably attached to the FUN part, so that said compound of General Formula [V] may slightly diffuse in the photographic material.

Some compounds which exemplify above CLASSES and Types, respectively, are shown as follows.

(Exemplary Compounds)

I-A (1)

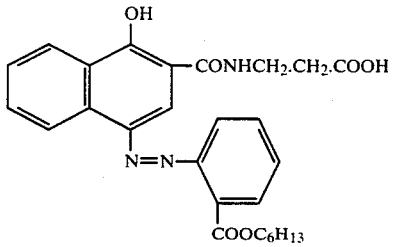

(2)

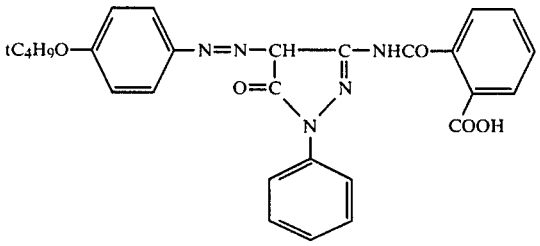

(3)

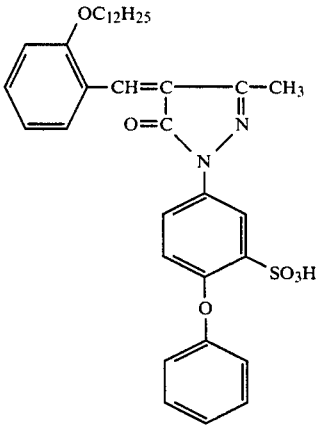

I-B (4)

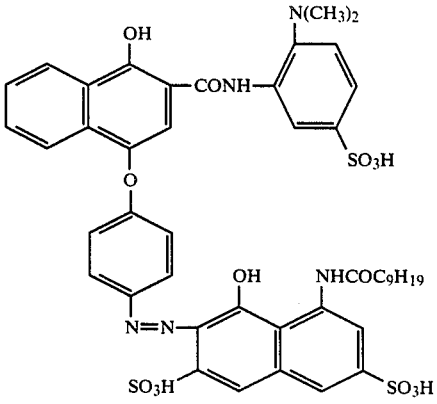

-continued
(Exemplary Compounds)
(5)
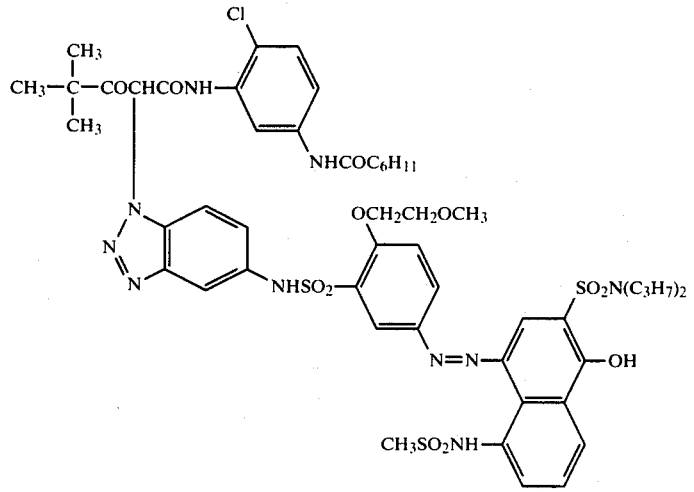
II-C
(6)
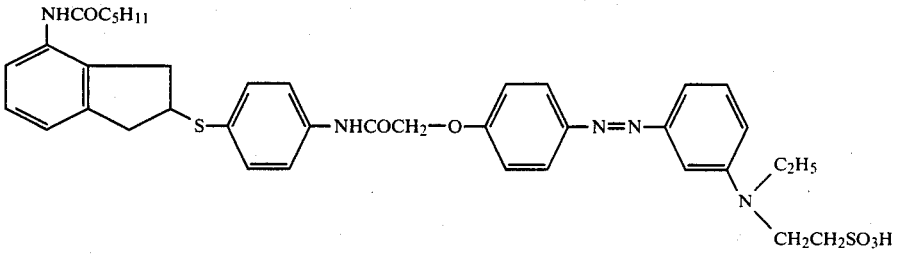
(7)
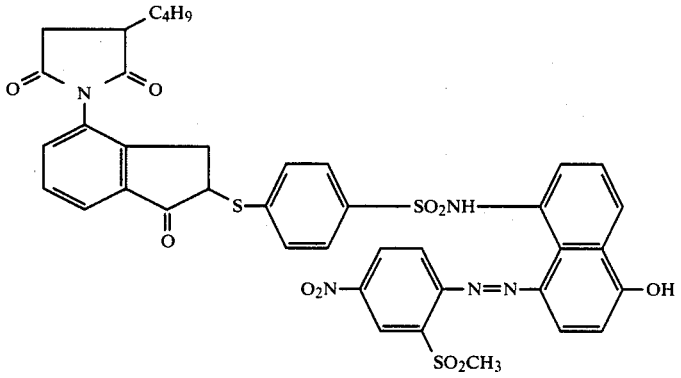
(8)
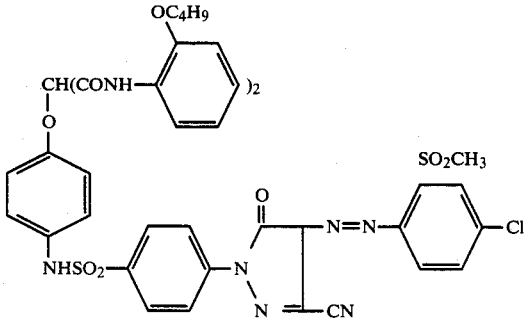

-continued (Exemplary Compounds)

(9)

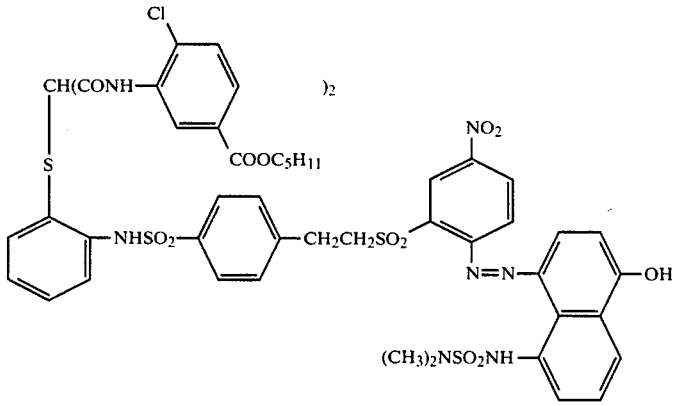

III-D (10)

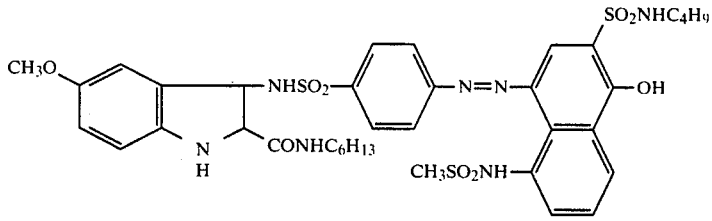

(11)

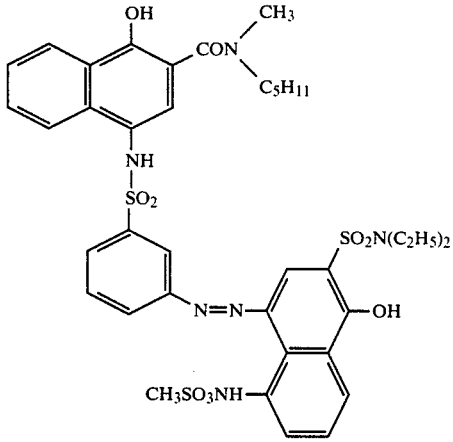

Exemplary Compound (11) is cited as an exemplification of III-D, but it is also an exemplification of I-B because it can also couple with the oxidant of a color developing agent.

Next, some synthesis examples of the compounds of the invention will be given below:

Synthesis Example 1

There suspended 29 g of anthranilic acid hexyl ester in 450 ml of 10% aqueous hydrochloric acid, and a 20% aqueous solution of 11.4 g of sodium nitrate was dropped thereinto at a temperature of not higher than 5° C. with stirring, so that the resulting solution may be diazotized. When keeping the temperature at not higher than 5° C. and stirring for about 30 minutes, the solution became a uniform solution of a diazonium salt, and the temperature thereof was kept as it was. Thereinto a solution prepared by dissolving 38.9 g of 1-hydroxy-2-β-carboxyethyl naphthamide in 750 ml of pyridine was kept at not higher than 10° C. and dropped while the solution of the diazonium salt was being stirred to finish up the dropping by taking about 30 minutes. After a further stirring was made for 30 minutes, the resulting solution was poured into the mixture of 4.5 liter of water and 750 ml of concentrated hydrochloric acid to obtain a red precipitate. Then, the precipitate was filtrated and recrystallized by ethyl acetate, so that Compound 1 was obtained. This compound is of red powder and indicates 490 nm at λmax in ethyl acetate.

Similarly, Compound 2, which was of yellow powder and had 425 nm at λmax in ethyl acetate; was prepared in such a manner that p-t-butoxyaniline in place of anthranilic acid hexyl ester was diazotized and whereto 1-phenyl-3-phthaloylamido-5-pyrazolone was coupled; and Compound 4, which was of red powder and had 525 nm at λmax in methanol, was prepared in such a manner that a diazonium salt of 1-hydroxy-4-(4-aminophenoxy)-2-(2-dimethylamino-4-sulfo)-1-naphthanilide is coupled to N-decanoylamino H acid.

Synthesis Example 2

Dissolution of 34.6 g of 1-(3-sulfo-4-phenoxy)-phenyl-3-methyl-5-pyrazolone was made in 700 ml of pyridine. Whereto 34.8 g of 2-dodecyloxybenzaldehyde were added and stirred for 30 minutes at 60° C. and then heated at 100° C. for 1.5 hours. After cooling down to room temperature, the resulting solution was poured into a mixture solution of 700 ml of conc. hydrochloric acid and 4 liter of water so as to produce light-yellow crystals. After filtrating the crystals, the crystals were recrystallized with methanol, so that Compound 3 was obtained. This compound indicates 415 nm at λmax in an ethyl acetate solution.

Synthesis Example 3

Dissolution of 28.6 g of 1-hydroxy-4-amino-2-(N-methyl-N-n pentylnaphthamide was made in 350 ml of acetonitrile. Whereto 57.5 g of 1-hydroxy-2-N,N-diethylsulfamino-5-methyl-sulfonylamino-4-(3-chlorosulfonylphenylazo)-naphthalene were added. While the resulting solution was stirred and suspended, 30 ml of pyridine was added and a boiling and reflux were made for one hour, so that the resulting solution became an almost uniform and dark red liquid containing a small amount of insoluble matters. After heat filtrating, acetonitrile was distilled off under reduced pressure and the residue was washed and was then recrystallized with methanol, so that red crystals of Compound 11 were obtained. This compound indicates 511 nm at λmax in ethyl acetate.

Similarly, there obtained respectively, Compound 6 having 420 nm at λmax in ethyl acetate, which is a condensation product of 2-(4-aminophenyl)thio-4-caproylamino-1-indanone and 4-(N-ethyl-N-sulfoethyl-)amino-4'-oxyacetylchloride-azobenzene; Compound 7 having 634 nm at λmax in methanol, which is a condensation product at 4-(3-butylsuccineimino)-2-(chlorosulfonylphenylthio-1-indanone and 5-amino-4-(4-nitro-2-methylsulfonyl)phenylazo-1-naphthol; and Compound 10 having 509 nm at λmax in methanol, which was obtained at 2-N-hexylcarbamido-3-amino-5-methoxyindole and 2-butylaminosulfonyl-5-methylsulfonylamino-4-(4-sulfochlorophenyl)azo-1-naphthol.

As aforementioned, a photographic material of the invdention has been a ballasted coupler combined with a photo-sensitive silver halide emulsion, and a compound of the invention.

The ballasted coupler is preferably contained by the photo-sensitive silver halide emulsion layer.

The compound of the invention is contained by said silver halide emulsion layer and/or another photograph-constituting layer than said silver halide emulsion layer.

Said different photograph-constituting layer is not essentially but preferably a layer adjacent to said silver halide emulsion layer, and preferably situated on the side opposite to the incidence of exposure. Said different photograph-constituting layer is allowed to be either another photo-sensitive silver halide emulsion layer being similar to said photo-sensitive halide emulsion layer in its photosensitivity, or a photo-insensitive layer. When the compound of the invention is contained by such a photo-insensitive layer, it reacts with developing agent(s) among various used developing agents, which diffuse into said photo-insensitive layer to form an unsharp mask image.

The using amount of the compound of the invention is preferably 0.01 to 1.00 mole, especially 0.05 to 0.60 moles per mole of the ballasted coupler to be combined with said compound. It can be added in a way similar to the case of the ballasted coupler as mentioned later.

The silver halide for photo-sensitive silver halide emulsions used in the invention is allowed to be any compound among silver bromide, silver iodobromide, silver iodochlordbromide, silver chlorobromide and silver chloride. The particles of the silver halide are allowed to have either a regular crystal form such as cubic, octahedral or tetra decahedral system; or an irregular crystal form such as sphere or plate. Furthermore the particles of the silver halide are allowed either to be composed of a complex of the above forms, or to be a mixture of various crystals. In addition, they are allowed to be composed of either a throughly homogeneous structure, or a laminarly heterogeneous structure from inside through outside.

These silver halide particles are useful regardless of having properties to make latent images form mainly on inside or on outside.

The silver halide emulsion of the invention is useful regardless of its particle size distribution. Either emulsion with a wide particle size distribution (called polydisperse emulsion) or emulsion with a narrow particle size distribution (called monodisperse emulsion) is evenly useful. Here, the monodisperse emulsion is referred to that it has a 0.15 or smaller value as the quotient of the standard deviation of the particle size distribution by the mean particle size. Said particle size is presented as the diameter for a spherical particle, and as the diameter of the sphere with the projected area identical with said particle for a nonspherical particle. Both polydisperse and monodisperse emulsions are useful eitheir separately or in the form of mixture of two or more of them.

The silver halide used in the invention is allowed to be chemically sensitized. In addition, it can be also sensitized optically in a desired wave region using a dye known as a sensitizing dye in the field of the photographic art. Such sensitizing dyes are applicable either separately or in the combination of two or more of them. A certain compound which is either dye having no spectral sensitizing effect in itself, or compound that does not substantially absorb any visible light, but is a supersensitizer that enforces the sensitizing effect of the sensitizing dye is allowed to be contained by the emulsion together with said sensitizing dye.

As for the binder of silver halide emulsion, various hydrophilic colloidal materials as well as gelatin are useful. Such gelatin materials include not only gelatin itself but also various gelatin derivatives such as gelatin's reaction products with various acid anhydrides, isocyanates, or active halogen atom-containing compounds. As acid anhydrides used in the reaction with gelatin, there are cited maleic, phthalic, benzoic, acetic, isatoic and succinic anhydrides, for example. As isocyanates, there are cited phenyl, p-bromophenyl, p-chlorophenyl, p-tolyl, p-nitro phenyl, and naphthyl isocyanates, for example.

As active halogen atom-containing compounds, such various compounds as benzenesulfonyl chloride, p-methoxybenzenesulfonyl chloride, p-phenoxybenzenesulfonyl chloride, p-bromobenzenesulfonyl chloride, p-toluenesjlfonyl chloride, m-nitrobenzenesulfonyl chloride, m-sulfobenzoyl dichloride, naphthalene-β-sulfonyl chloride, p-chlorobenzenesulfonyl chloride, 3-nitro-4-aminobenzenesulfonyl chloride, 2-carboxy-4-bromo benzenesulfonyl chloride, m-carboxybenzenesulfonyl chloride, 2-amino-5-methylbenzenesulfonyl chloride, phthaloyl chloride, p-nitrobenzoyl chloride, benzoyl chloride, ethyl chlorcarbonate and furoyl chloride are included, for example.

As the hydrophilic colloid to make the silver halide emulsion, varied other substances may be used at need besides such gelatin derivative as mensioned above, and common photographic gelatins. These substances include colloidal albumin, agar, gum arabic, dextran, alginic acid; cellulose derivatives such as partially hydrolysed cellulose acetate with 19% to 26% of acetyl content; polyacrylamide, imidized polyacrylamide, casein; urethanecarboxylic group- or cyanoacetyl group-containing vinylalcoholic polymers such as vinylalcoholvinyl cyanoacetate copolymers; polyvinylalcohol-polyvinylpyrrolidone, hydrolysed polyvinyl acetate; polymers obtained from vinyl group-containing monomers, and protein itself or protein saturated with acyl group; polyvinylpyridine, polyvinylamines, polyaminoethyl methacrylate, and polyethyleneimine for example.

Silver halide emulsions used in the invention may be allowed to contain various known surface active agents for various purposes such as coating aid, static prevention, slip improvement, dispersion aid, stick prevention; and picture improvement including promotion of development, contrast improvement, and sensitization.

As to use of such surface active agents, there can be seen, for example, in specifications of U.S. Pat. Nos. 2,240,472, 2,831,766, 3,158,484, 3,210,191, 3,294,540 and 3,507,660; British Pat. Nos. 1,012,495, 1,022,878, 1,179,290 and 1,198,450; U.S. Pat. Nos. 2,739,891 and 2,823,123; British Pat. No. 1,179,290; U.S. Pat. Nos. 3,058,101, 3,415,649, 3,666,478 and 3,756,828; British Pat. No. 1,397,218; U.S. Pat. Nos. 3,113,816, 3,411,413, 3,473,174, 3,345,974, 3,726,683 and 3,843,368; Belgian Pat. No. 731,126; British Pat. Nos. 1,138,514, 1,159,825 and 1,374,780; U.S. Pat. Nos. 2,271,623, 2,288,226 2,944,900, 3,235,919, 3,671,247, 3,772,021, 3,589,906 and 3,754,824; and West German patent application OLS No. 1,961,683; and Japanese Patent O.P.I. Publication Nos. 117414/1975 and 59025/1975; Japanese Patent EP Publication Nos. 378/1965, 379/1965 and 13822/1968. Such surface active agents may be allowed to be, for example, nonionic surface active agents including steroid saponins; alkylene oxide derivatives such as polyethene alycol, polyethylene glycol-polypropylene glycol condensates, polyethylene glycol alkyl or alkylaryl ether polyethylene glycols, polyethylene glycol sorbitan esters, polyalkylene glycol aklylamines or alkylamides, and silicone-polyethylene oxide adducts; glycidol derivatives such as alkenylsuccinic polyglycerides, and alkylphenol polyglycerides; esters of polyhydric alcohols and fatty acids; anion surface active agents, which contain acid groups such as carboxyl, sulfo, phospho, sulfate ester or phosphate ester group, including triterpenoid saponins, alkylcarboxylates, alkylbenzenesulfonates, alkylnaphthalenesulfonates, alkyl sulfates, alkyl phosphates, N-acyl-N-alkyltairine compounds, sulfosuccinic esters, sulfoalkylpolyoxyethylene alkylphenyl ethers, and polyoxyethylene alkyl phosphates; ampholytic surface active agents such as aminoacids, aminoalkylsulfonic acids, aminoalkyl sulfates or aminoalkyl phosphates, alkylbetaines, amine imides, and amine oxides; and cationic surface active agents such as alkylamines, aliphatic or aromatic quarternary ammonium salts; heterocyclic quarternary ammonium salts such as pyridium or imidazolium salts; and aliphatic chain - or heterocyclic ring-containing sulfonium compounds or sulfonium salts.

Further, silver halide emulsions used in the invention may be allowed to contain, besides the above surface active agents, any of imidazole, thioether and selenoether compounds which are described in specification of West German patent application OLS Nos. 2,002,871, 2,445,611 and 2,360,878; and British Pat. No. 1,352,196.

The ballasted couplers are preferably contained by photosensitive silver halide layers afore-mentioned, then, for example, yellow, magenta and cyan ballasted couplers are used in combination with blue-, green- and red-sensitive silver halide emulsions, respectively. Each of said ballasted couplers preferably has lipophilic group(s) such as 2,4-di-t-amylphenoxyalkaneamido group in its molecule so that it may not diffuse in the photograph-constituting layers.

Said coupler is allowed to be used by either 4 or 2 equivalents to silver ion. Colored couplers having color correcting effects or couplers (called DIR couplers) which release development inhibitors during developing treatments are allowed to be contained.

Part of said couplers are allowed to be couplers whose coupling reaction products are colorless.

As yellow couplers, well-known couplers of open-chained ketomethylene type can be used. Among them, compounds of benzoyl acetanilide and pivaloyl acetanilide types are favorably used. Useful yellow couplers are cited in U.S. Pat. Nos. 2,875,057, 3,408,194 and 3,519,429; Japanese Patent O.P.I. Publication Nos. 26133/1972, 29432/1973, 87650/1975, 17438/1976 and 102636/1976; and Japanese Patent Examined Publication Nos. 19956/1970, 33410/1976, 10783/1976 and 19031/1972, for example, and among them, the following compounds are especially favorable:

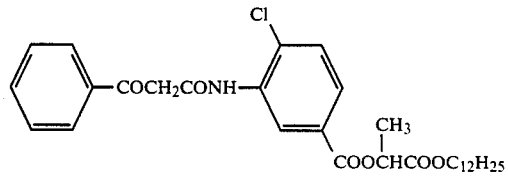

(1)

-continued
(2)
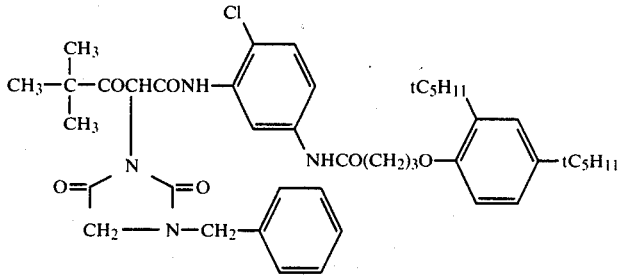
(3)
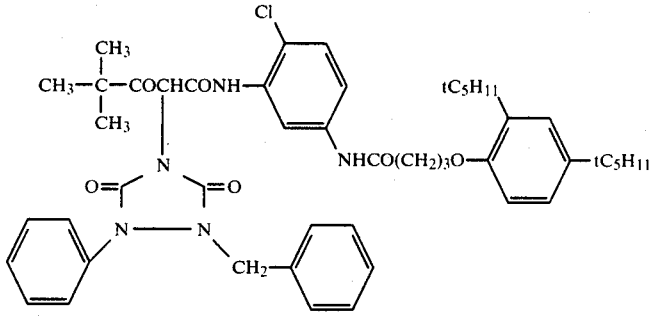
(4)
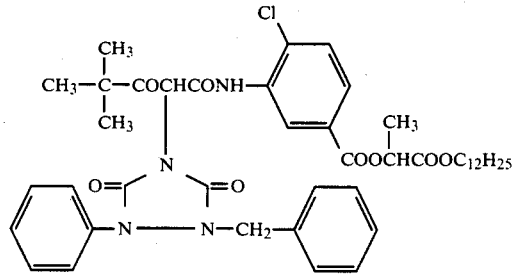
(5)
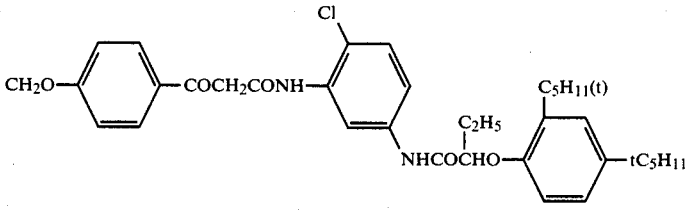
(6)
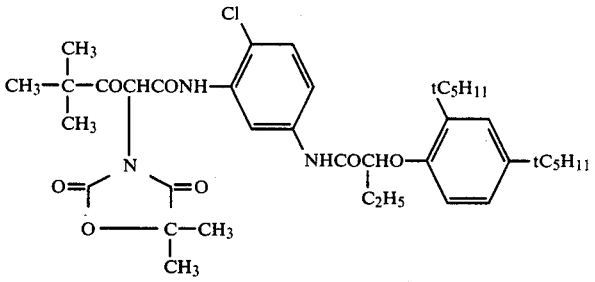
(7)
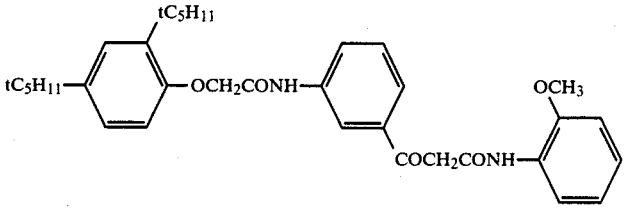

-continued
(8)
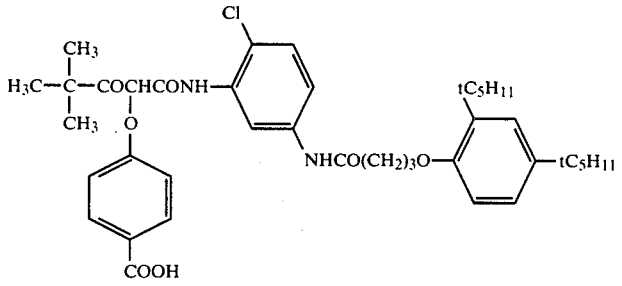
(9)
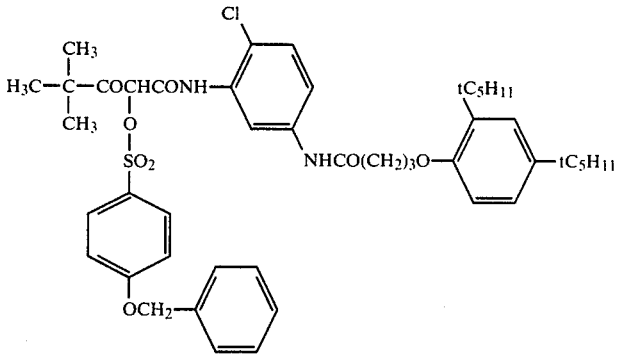
(10)
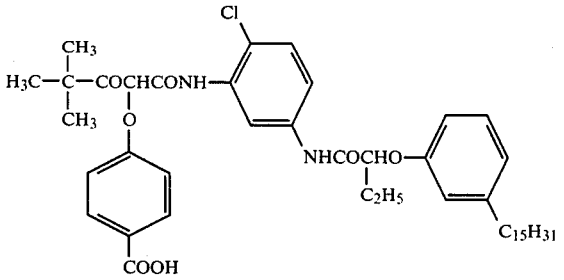
(11)
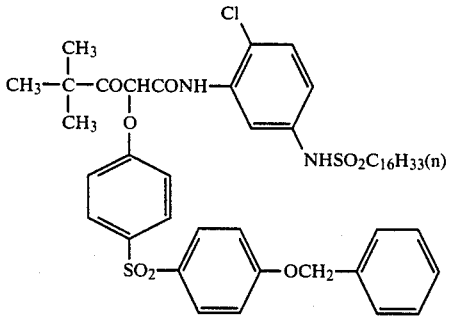
(12)
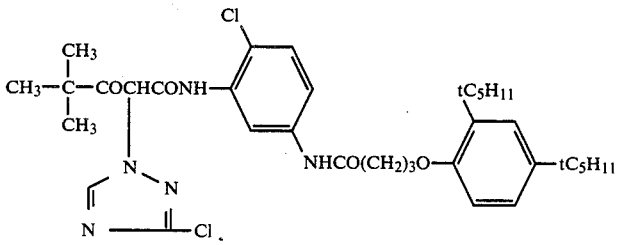

-continued (13)

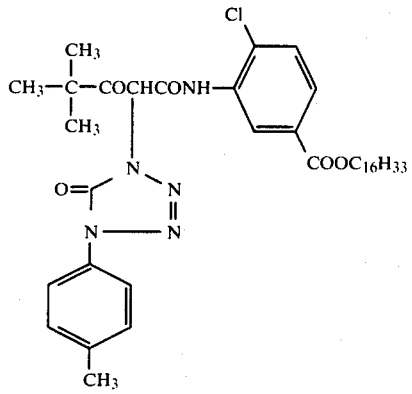

(14)

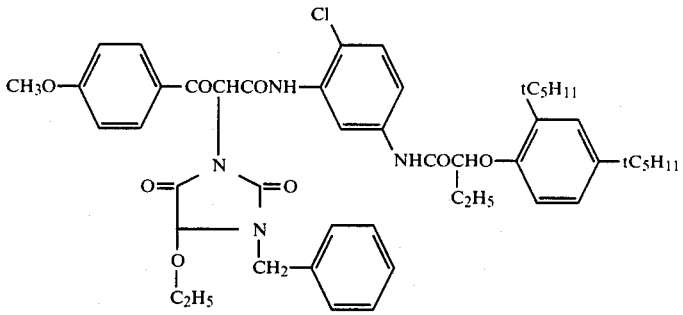

(15)

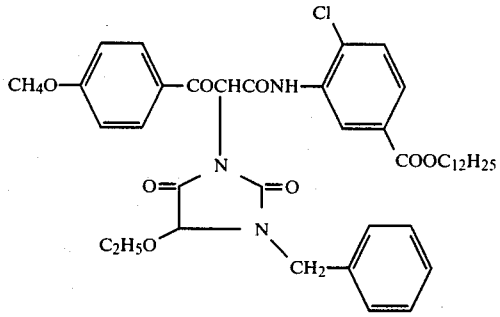

(16)

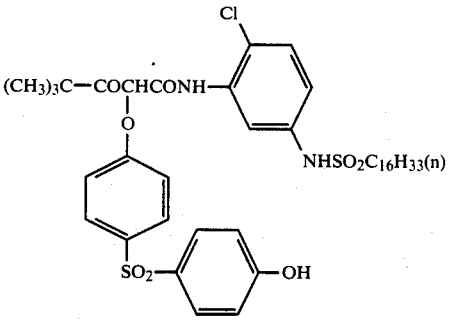

As magenta couplers, compounds of pyrazolone, indazolone cyanoacetyl pyrazolotriazole and pyrazolinobenzimidazole types can be used, and compounds of pyrazolone type and especially favorable. Useful magenta couplers are cited in U.S. Pat. Nos. 2,600,788, 3,062,053, 3,408,194 and 3,519,429; Japanese Patent O.P.I. Publication Nos. 111631/1974, 29236/1981 and 94752/1982; and Japanese Patent Examined Publication No. 27930/1973, for example, and among them, the following compounds are especially preferable:

(1)
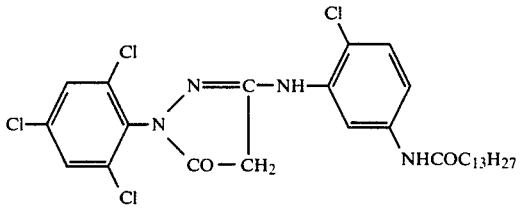
(2)
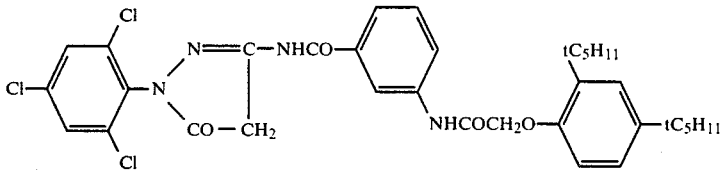
(3)
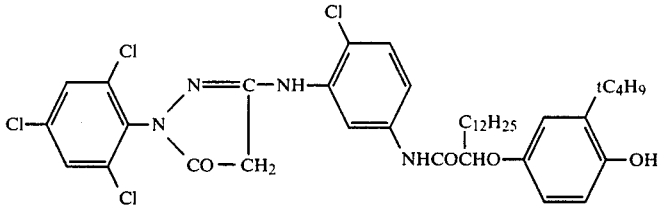
(4)
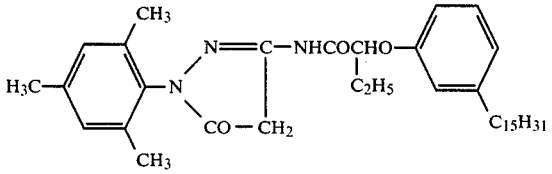
(5)
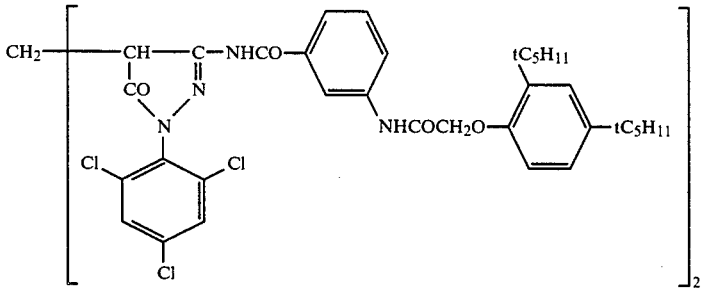
(6)
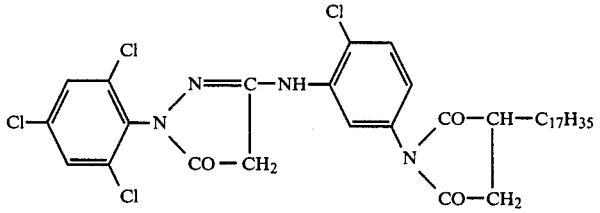
(7)
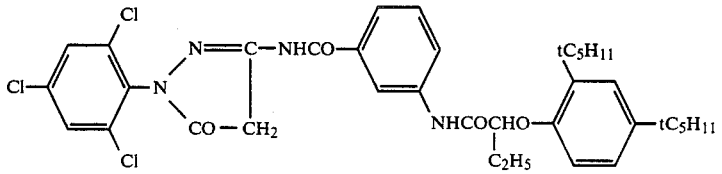

-continued (8)

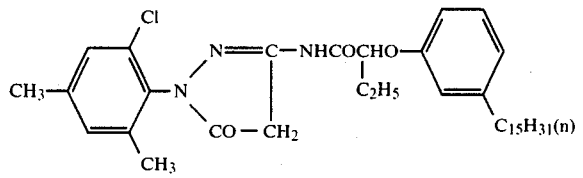

(9)

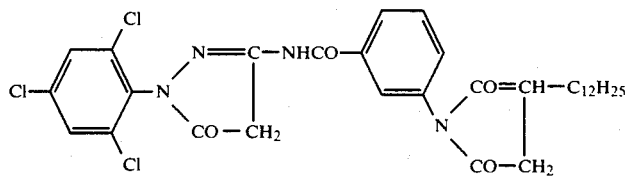

(10)

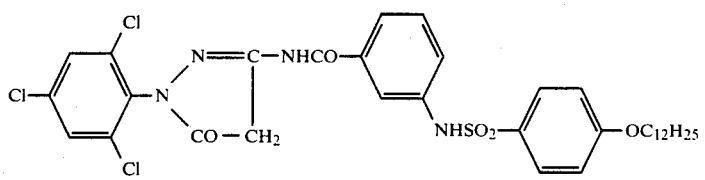

(11)

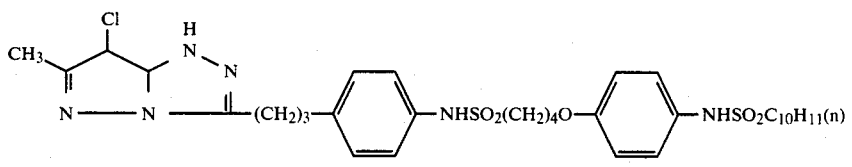

(12) A polymeric coupler latex made by impregnating copolymer of 1-(2,4,6-trichlorophenyl)-3-(3-acrylamido benzamido)-4-pyrazolyl-5-oxo-2-pyrazoline and n-butyl acrylate (20:80) with the above magenta coupler (2).

As cyan couplers, compounds of phenol and naphthol types can be used. Useful compounds are cited in U.S. Pat. Nos. 2,423,730, 2,474,293 and 2,895,826; Japanese Patent O.P.I. Publication No. 117422/1975; and Japanese Patent Registration No. 127513, for example, and among them, the following compounds are especially preferable:

(1)

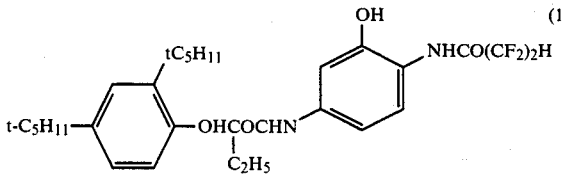

(2)

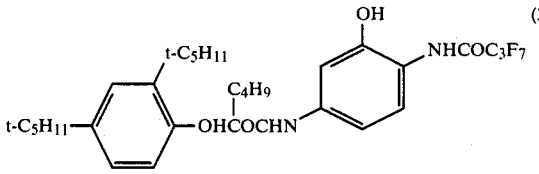

(3)

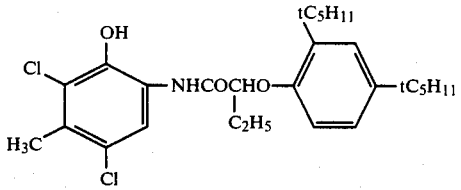

(4)

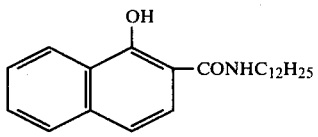

(5)

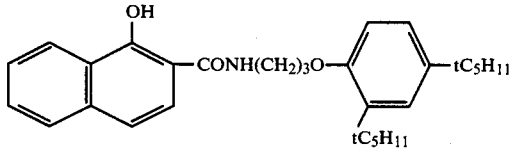

(6)

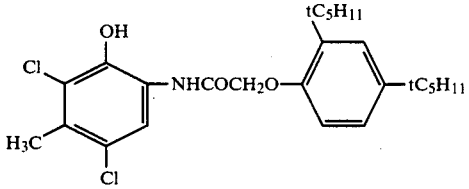

-continued
(7)
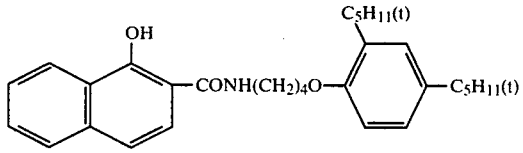
(8)
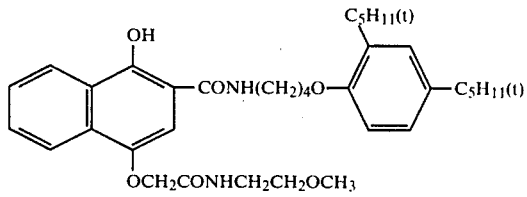
(9)
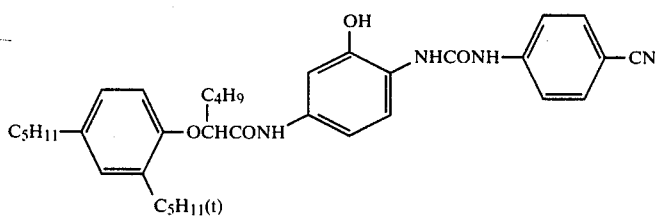
(10)
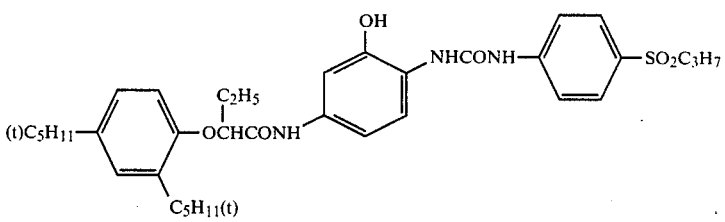
(11)
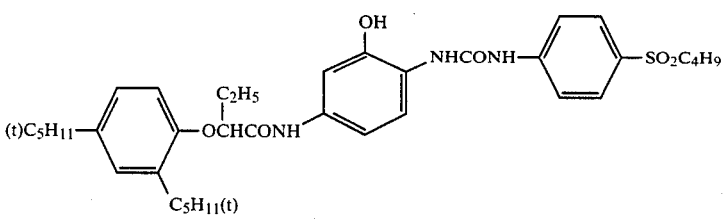
(12)
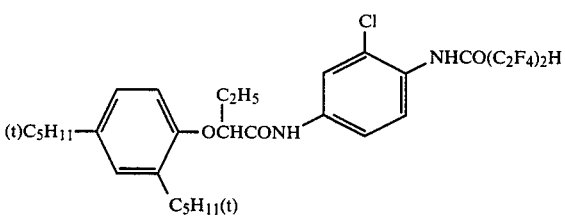
As colored magenta couplers, useful compounds are cited in U.S. Pat. Nos. 2,801,171 and 3,519,429; and Japanese Patent Examined Publication No. 2790/1973, for example, and among the following compounds are especially preferable:
(1)
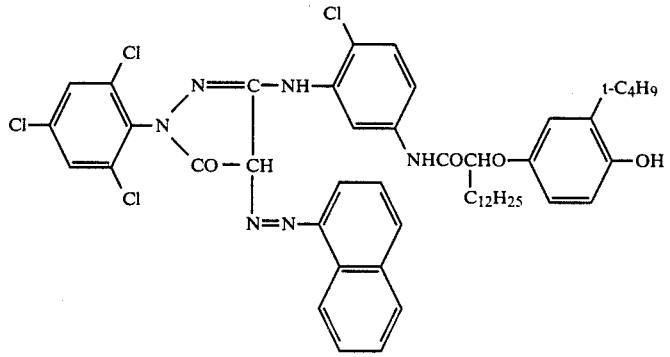

-continued (2)

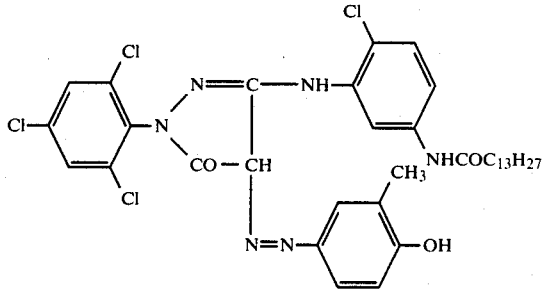

(3)

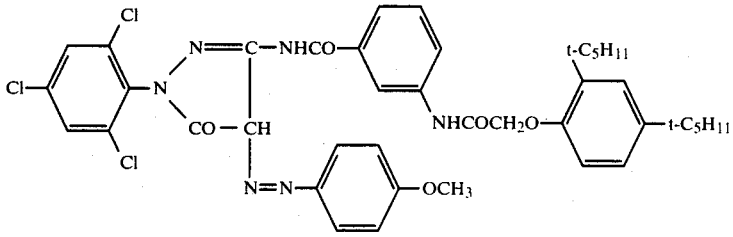

(4)

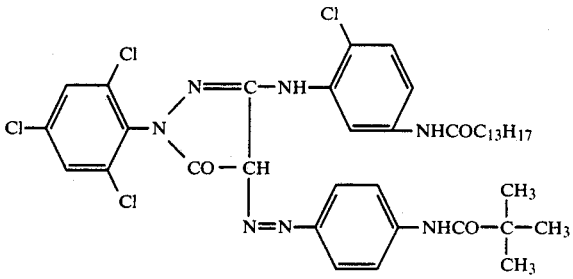

(5)

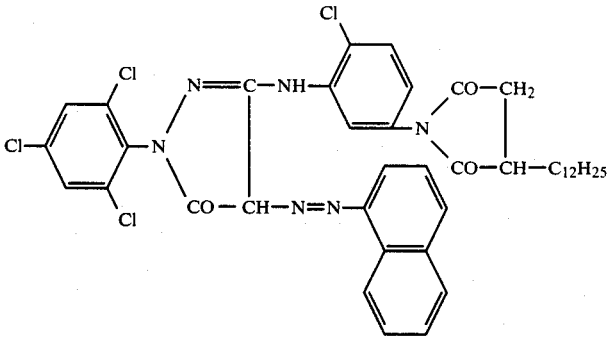

As colored cyan coupler, useful compounds are cited in British Pat. No. 1,084,480, and Japanese Patent Examined Publication No. 32461/1980, for example, and among them, the following compounds are especially preferable:

(1)

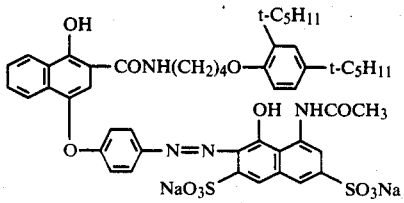

-continued (2)

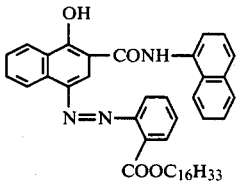

(3)

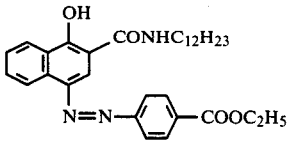

The above various couplers can be contained also two or more combined together by the same layer. The same compound is allowed to be contained by two or more different layers.

To introduce such a coupler into the silver halide emulsion layer of the invention, such a method as described in U.S. Pat. No. 2,322,027 for example, is applicable. For example, the coupler may be dissolved into any of the following solvent system, and then dispersed into the emulsion: dialkyl phthalates such as dibutyl, and dioctyl phthalates; and phosphoric esters such as diphenyl, triphenyl, tricresyl, and dioctyl butyl phosphates; alkylamides such as diethyl lauramide and the like. For the same purpose, some organic solvents with boiling points ranging from about 30° C. to about 150° C., including lower alkyl acetates such as ethyl and butyl acetates, ethyl bropionate, sec-butyl alcohol, methyl isobutyl ketone, $\beta$-ethoxyethyl acetate, and methylcellosolve acetate, also are applicable. Furthermore, some mixture of the above high and low boiling organic solvents also may be applicable. Anyway, the obtained solution is dispersed into the hydrophilic colloid system. Certain mixture of the above higher and lower boiling-point organic solvents also are useful.

When such a coupler has an acid group such as carboxylic or sulfonic acid group, it is introduced into the hydrophilic colloid system as its alkaline solution.

Such a coupler is, in general, added to the colloid system at concentrations ranging from $2\times10^{-3}$ moles, to $5\times10^{-1}$ moles, preferably from $1\times10^{-2}$ mole to $5\times10^{-1}$ moles per mole of silver contained in the silver halide emulsion layers.

In addition, certain DIR compounds can be used for the photographic material of the invention. Such DIR compounds preferably may be compounds described in U.S. Pat. Nos. 2,327,554, 3,227,554 and 3,615,506; Japanese Patent OPI Application Nos. 82424/1977, 145135/1979 and 151944/1982; and Japanese Patent Examined Publication No. 161141/1976 for example. Especially preferable DIR compounds are as follows:

(1)

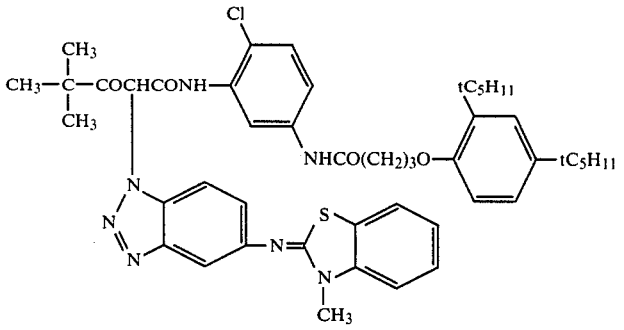

(2)

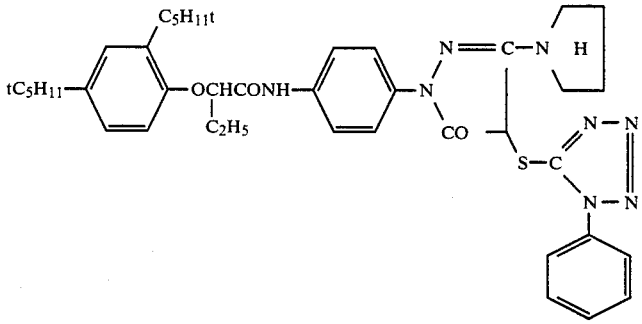

(3)

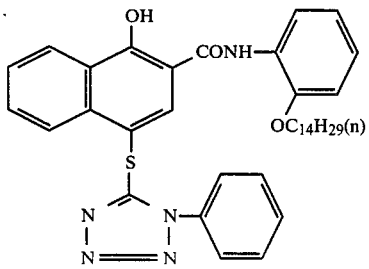

(4)

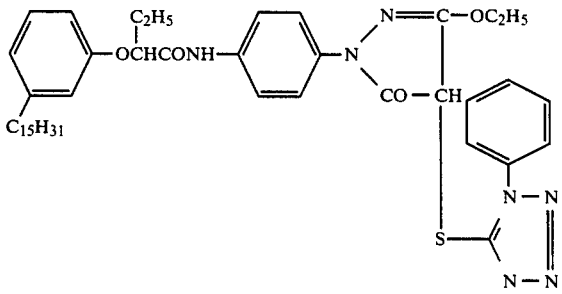

-continued
(5)
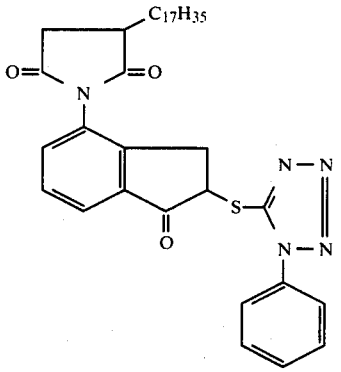
(6)
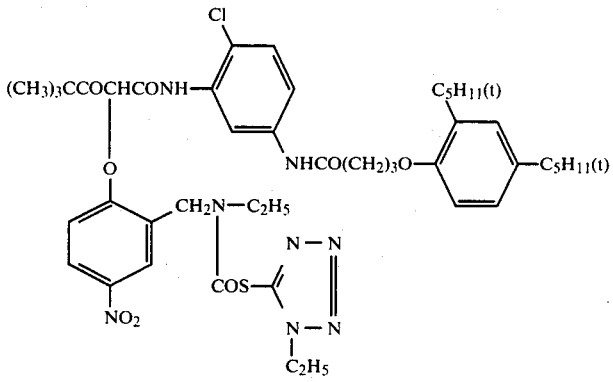
(7)
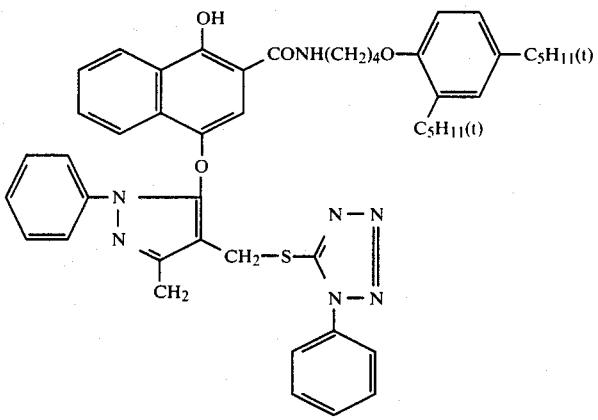
(8)
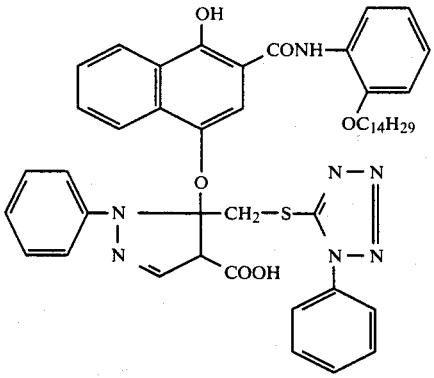
(9)
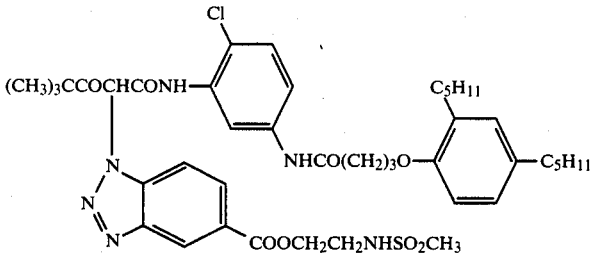
As an antistaining agent effectively applicable to the photographic material of the invention, the following compounds are cited in U.S. Pat. No. 2,728,659, and Japanese Patent O.P.I. Publication No. 2128/1971, and the following compound are especially preferable:
(1)
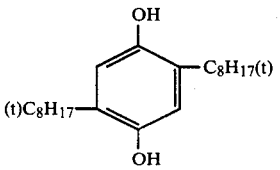

-continued

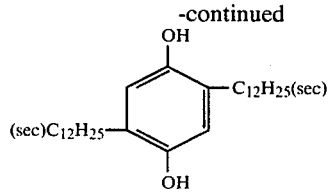

(2)

As an antistatic agents effectively used in the invention, there are diocetylcellulose; styrene-perfluoroalkyl sodium maleate copolymer; and alkali salt of reaction product from styrene-maleic anhydride copolymer and p-aminobenzenesulfonic acid. As a matting agent, polymethyl methacrylate, polystyrene, and alkali-soluble polymers are useful. Colloidal silica also may be useful. As a latex added for the purpose of improving film properties, latices of copolymers of acrylic esters or vinylesters with other ethylene group-having monomers are useful. As a plasticizer for gelatin, glycerol or glycol compounds are useful. As a thickner, styrene-sodium maleate copolymer, alkyl vinyl ether-maleic acid copolymer and the like are useful.

As a support for the photographic material which is prepared using silver halide emulsion made in such ways as mentioned above, there are useful, for example, barite paper, polyethylene-coated paper, polypropylene synthetic paper, glass plates, cellulose acetate, celluldse nitrate, polyvinylacetal, polypropylene; polyester films such as polyethylene terephthalate film; and polystyrene; and the support for the photographic material of the invention is selected among them properly according to the purpose of application.

The support is often undercoated at need.

The photographic material of the invention prepared using silver halide emulsion can be, after exposure to light, treated for development using common well-known methods. For example, it can be, after color developing, either bleached and fixed simultaneously, and rinsed if necessary, and then stabilized; or bleached and fixed separately, and rinsed if necessary, and then stabilized.

As a color developing agent, various aromatic primary amine developing agents such as p-phenylenediamine- and p-aminophenol-type compounds are preferably used.

CONCRETE EXAMPLES OF THE INVENTION

Concrete descriptions of the invention are given with examples below:

EXAMPLE 1

A multilayered color photographic material is prepared by having eight layers which have respective compositions as shown below, form on a support of cellulose triacetate film in order.

First layer (a antihalation backing):

A layer is formed by coating black colloidal silver-containing gelatin solution by 50 mg silver and 0.5 g gelatine per $m^2$.

Second layer (the first intermediate layer):

A gelatin layer which contains emulsified dispersion of 2,5-di-t-octylhydroquinone.

Third layer (a red-sensitive emulsion layer):

A highly red-sensitive emulsion is prepared by color sensitizing a silver iodobromide emulsion which contains 4 mol % silver iodide and has 0.7$\mu$ average particle size using a mixture of anhydro-5,5'-dichloro-3,3'-di-$\gamma$sulfopropyl-9-ethyl-thiacarbocyanine hydroxide pyridium salt and anhydro-9-ethyl-3,3'-di-$\gamma$-sulfopropyl-4,5,4',5'-dibenzothiacarbocyanine hydroxide triethylamine salt (4:1). Then the emulsion is stabilized by adding a proper amount of 4-hydroxy-6-methyl-1,3,3a,7-tetrazaindene. 1-Hydroxy-N-[$\alpha$-(2,4-di-t-amylphenoxy)butyl]-2-naphthoamide, as a ballasted cyan coupler, by 0.07 moles per mole of silver is dissolved in tricresyl phosphate in the usual way, and is emulsified into another gelatin aqueous solution, and then is added to the former silver halide emulsion. Then the third layer is formed by coating the obtained mixture by 3.1 g silver and 5.0 g gelatin per $m^2$. Fourth layer (the second intermediate layer):

Another gelatin layer which contains emulsified dispersion of 2,5-di-t-octylhydroquinone. Fifth layer (a green-sensitive emulsion layer):

A highly green-sensitive emulsion is prepared by color sensitizing a silver iodobromide emulsion which contains 5 mol% silver iodide and has 0.75$\mu$ average particle size using a mixture of anhydro-9-ethyl-5,5'-dichloro-3,3'-di-($\gamma$-sulfopropyl)oxacarbocyanine sodium salt and anhydro-5,6,5',6'-tetrachloro-1,1'-diethyl-3,3'-di-($\gamma$-sulfopropyl)imidazolocarbocyanine hydroxide triethylamine salt (3:1). Then the emulsion is stabilized by adding 4-hydroxy-6-methyl-1,3,3a,7-tetrazaindene. An emulsified dispersion which contains 1-(2,4,6-trichlorophenyl)-3-[3-{$\alpha$-(2,4-di-t-amylphenoxy)acetamido}-benzamido]-5-pyrazolone, as a ballasted magenta coupler, by 0.08 moles per mole of silver, is added to the former silver halide emulsion. The obtained mixture is referred to the reference control. An aliquot of this control is further added to with an emulsified dispersion which contains the exemplary compound (4) by 0.008 moles per mole of silver. The obtained mixture is referred to the correspondent according to the invention. Both the control and the correspondent are coated by 2, 3 g silver and 2.7 g gelatin per $m^2$, respectively.

Sixth layer (a yellow-filtering layer):

A gelatin layer which contains dispersion of both yellow colloidal silver and 2,5-di-t-octylhydroquinone by 0.1 g silver and 1.2 g zelatin per $m^2$.

Seventh layer (a blue-sensitive emulsion layer):

A highly-sensitive silver iodobromide emulsion in gelatin which contains 6 mol % silver iodide and has 0.8$\mu$ average particle size is added to with a proper amount of 4-hydroxy-6-methyl-1,3,3a,7-tetrazaindene as a stabilizer, and then with an emulsified dispersion which contains d-[4-(1-benzyl-2-phenyl-3,5-dioxo-1,2,4-triazolidinyl)]-$\alpha$-pivalyl-2-chloro-5-[$\gamma$-(2,4-di-t-amylphenoxy)butyramido]acetanilide, as a ballasted yellow coupler, by 0.22 moles per mole of silver. The obtained mixture is referred to the refereence control.

An aliquot of this control is further added to with an emulsified dispersion which contains the exemplary compound (3) by 0.07 moles per mole of silver. The obtained mixture is referred to the correspondent according to the invention. Both the control and the correspondent are coated by 1.0 g silver and 3.0 g gelatin per $m^2$.

Eighth layer (a protective layer):

A gelatin layer which contains particles of polymethyl methacrylate with 1.5$\mu$ average particle size.

2-Hydroxy-4,6-dichloro-s-triazine sodium solt or bis-(vinylsulfonyl)ethane as a gelatin film stiffner, and a certain surface active agent is added to the gelatin solution for every layer.

Both the control and correspondent photographic materials are dried, exposed to light, and then submitted to the following treatments for development in order to determine their MTF values by passing through blue, green and red filters:

| Treating procedure (at 38° C.) | Time |
|---|---|
| Color developing | 3¼ minutes |
| Bleaching | 6½ minutes |
| Fixing | 3¼ minutes |
| Rinsing | 6½ minutes |
| Stabilizing | 1½ minutes |

Treating soltions available in the above procedures have, for example, the following compositions, respectively:

| | |
|---|---|
| Color developing solution | |
| 4-Amino-3-methyl-N—ethyl-N—(β-hydroxyethyl) aniline sulfate | 4.8 g |
| Sodium sulfite, anhydrous | 0.14 g |
| Hydroxylamine hemisulfate | 1.98 g |
| Sulfuric acid | 0.74 mg |
| Potassium carbonate, anhydrous | 28.85 g |
| potassium bicarbonate anhydrous | 3.46 g |
| Potassium sulfite, anhydrous | 5.10 g |
| Potassium bromide | 1.16 g |
| Sodium chloride | 0.14 g |
| Nitrilotriacetic acid trisodium salt, monohydrous | 1.20 g |
| Potassium hydroxide | 1.48 g |
| Diluting with water to 1000 ml. | |
| Bleaching Solution | |
| Ethylenediaminetetraacetic acid ferric ammonium salt | 100 g |
| Ethylenediaminetetraacetic Diamonium | 10 g |
| Ammonium bromide | 150 g |
| Glacial acetic acid | 10 ml |
| Diluting with water to 1000 ml, and adjusting pH to 6.0 with aqua ammonia. | |
| Fixing Solution | |
| Ammonium thiosulfate | 175.0 g |
| Sodium sulfite, anhydrous | 8.6 g |
| Sodium methasulfite | 2.3 g |
| Diluting with water to 1000 ml, and adjusting pH to 6.0 with acetic acid. | |
| Stabilizing solution | |
| Formalin (37%) | 1.5 ml |
| Konidaks (Konishiroku) | 7.5 ml |
| Diluting with water to 1000 ml. | |

The images obtained in the above ways have the image sharpness shown in Table 1 (represented as MTF at frequency of 20 lines per mm):

TABLE I

| | | Control | Example |
|---|---|---|---|
| MTF VALUE, % | Blue | 80 | 87 |
| | Green | 75 | 81 |
| | Red | 68 | 70 |

These results clearly indicate an MTF improving effect by the invention. Even though any compound relevant to the invention never is added to the third layer (the red-sensitive emulsion layer) of this example, the MTF of that layer is inferred to be also improved due to the anti-irradiation effect of the upper layers.

EXAMPLE 2

An emulcified dispersion is prepared by adding the exemplary compound (7) to a red-sensitive emulsion similar to the one for the third layer in Example 1 by 0.25 moles per mole of silver. By coating this dispersion by 0.72 g silver and 2.08 g gelatin per $m^2$, a layer masking in the red-sensitizing layer is formed between the second and third layers of the sample of the invention (the correspondent) in Example 1. Another emulsified dispersion is prepared by adding the exemplary compound (11) to a green-sensitive emulsion similar to the one for the fifth layer in Example 1 by 0.25 moles per mole of silver. By coating this dispersion by 0.3 g silver and 0.4 g gelatin per $m^2$, a layer masking in the green-sensitizing layer is formed between the fourth and fifth layers of the same sample. Further, another emulsified dispersion is prepared by adding the exemplary compound (2) to a blue-sensitive emulsion similar to the one for the seventh layer in Example 1 by 0.25 moles per mole of silver. By coating this dispersion by 0.29 silver and 0.6 g gelatin per $m^2$, a layer masking in the blue-sensitizing layer is formed between the sixth and seventh layers of the same sample. The other procedures are carried out according to the same way as in Example 1. The obtained sample exhibits definite color images according to the same exposure and developing treatments as in Example 1.

EXAMPLE 3

Between the second and third layers of the sample of the reference in Example 1, a layer having 2.0 g gelatin per $m^2$ is formed by coating an emulsified dispersion which contains 0.0017 moles of the exemplary compound (9). Between the fourth and fifth layers of the same sample, a layer having 0.4 g gelatin per $m^2$ is formed by coating an emulsified dispersion which contains 0.0007 moles of the exemplary compound (8). Further between the sixth and seventh layers of the same sample, a layer having 0.6 g gelatin per $m^2$ is formed by coating an emulsified dispersion which contains 0.00046 moles of the exemplary compound (2). The other procedures are carried out according to the same way as for the sample of the reference in Example 1. The obtained sample exhibits definite color images according to the same expoure and developing treatments as in Example 1.

EXAMPLE 4

A multilayered color photographic material is prepared by having thirteen layers which have respective compositions as shown below, form on a support of cellulose triacetate film in order.

First layer (an antihalation backing):

A layer is formed by coating black colloidal silver-containing gelatin solution at 50 mg silver and 0.5 g gelatin per $m^2$.

Second layer (the first intermediate layer):

A gelatin layer which contains emulsified dispersion of 2,5-di-t-octylhydroquinone.

Third layer (a layer masking in a red-sensitizing level):

A highly red-sensitive emulsion is prepared by color sensitizing a silver indobromide emulsion which contains 4 mol % silver iodide and has 0.7μ average particle size using a mixture of anhydro-5.5'-dichloro-3,3'-di-γ-sulfopropyl-9-ethyl-thiacarbocyanine hydroxide pyridum salt and anhydro-9-ethyl-3,3'-di-γsulfopropyl-4,5,4',5'-dibenzothiacarbocyanine hydroxidetriethylamine salt (4:1). Then the emulsion is stabilized by adding a proper amount of 4-hydroxy-6-methyl-1,3,3a,7-tetrazaindene. The exemplary compound (7) by 0.25 moles per mole of silver is dissolved in tricresyl phosphate, and emulsified into another aliquot of gelatin solution, and then is added to the former silver halide emulsion. Then, the third layer is formed by coating the obtained mixture at 0.72 g silver and 2.0 g gelatin per $m^2$.

Fourth layer (a low red-sensitive emulsion layer):

Instead of the silver iodobromide emulsion for the third layer, there is adopted another silver iodebromide emulsion which contains 5 mol % silver iodide and has 0.4μ average particle size. Instead of the exemplary compound (7) for the third layer, there are adopted. 1-hydroxy-N-[a-(2,4, di-t-amylphenoxy)-butyl]-2-naphthamide, as a ballasted cyan coupler, by 0.07 moles per mole of silver; 1-hydroxy-4-(2-carboethoxyphenylazo)-N-[α-(2,4-di-t-amylphenoxy)nutyl]-2-naphthamide, as a colored cyan coupler, by 0.007 moles per mole of silver; and 2-(1-shenyl-5-tetrazolylthio)-6-[α-2,4-di-t-amylphenoxy)acetamido]indanone by 0.003 moles per mole of silver. The other procedures are carried out in the same way as for the third layer to obtain the fourth layer with 1.8 g silver and 2.0 g gelatin per $m^2$.

Fifth layer (a highly red-sensitive emulsion layer):

Instead of the exemplary compound (7) for the third layer, there are adopted 1-hydroxy-4-ethoxycarbonylmethyloxy-N-[α-(2,4-di-t-amylphenoxy)butyl]-2-naphthamide, as a ballasted cyan coupler, by 0.02 moles per mole of silver; and 2-(1-phenyl-5-tetrazolylthio)-6-[α-(2,4-di-t-amylphenoxy)acetamido]indanone by 0.001 mole per mol of silver. The other procedures are carried out in the same way as for the third layer to obtain the fifth layer with 2.0 g silver and 3.0 g gelatin per $m^2$.

Sixth layer (the second intermediate layer):

A gelatin layer which contains emulscfied dispersion of 2,5-di-t-octylhydroquinone.

Seventh layer (a layer masking in a green-sensitizing layer):

A highly green-sensitive emulsion is prepared by color sensitizing a silver iodobromide emulsion which contains 5 mol % silver iodide and has 0.75μ average particle size using a mixture of anhydro-9-ethyl-5,5'-dichloro-3,3'-di-γ-sulfopropyl)oxacorbocyanine sodium salt and anhydro-5,6,5',6'-tetracgloro-1,1'-diethyl-3,3'-di-(γ-sulfopropyl)imidazolocarbocyanine hydroxide triethylamine salt (3:1). Then the emulsion is stabilized by adding a proper amount of 4-hydroxy-6-methyl-1,3,3a,7-tetrazaindene.

An emulsified dispersion which contains the exemplary compound (1) by 0.25 moles per mole of silver is added to the former silver halide emulsion. Then, the seventh layer is formed by coating the obtained mixture at 0.3 g silver and 0.4 g gelatin per $m^2$.

Eighth layer (a low green-sensitive emulsion layer):

Instead of the silver iodobromide emulsion for the seventh layer, there is adopted another silver iodobromide emulsion which contains 4 mol % silver iodide and has 0.35μ average particle size. Instead of the exemplary compound (1) for the seventh layer, there is adopted 1-(2,4,6-trichlorophenyl)-3-[3α-(2,4-di-t-amylphenoxy)acetamido}-benzamido]-5-pyrazolone, as a ballasted magenta coupler, by 0.08 moles per mole of silver; 1-(2,4,6-trichlorophenyl)-3-[3-}α-(2,4-di-t-amylphenoxy)acetamido}benzamido]-4-(4-methoxyphenylazo)-5-pyrazolone, as a colored coupler, by 0.015 moles per mole of silver; and 2-(1-phenyl-5-tetrazolylthio)-6-[α-(2,4-di-t-amylphenoxy)acetamido]indanone by 0.003 moles per mole of silver. The other procedures are carried out in the same way as for the seventh layer to obtain the eighth layer with 1,0 g silver and 1,1 g gelatin per $m^2$.

Ninth layer (a highly green-sensitive emulsion layer):

Instead of the exemplary compound (1) for the seventh layer, there are adopted 4,4-bismethylene-[1-(2,4,6-trichlorophenyl)-3-{3-(α-(2,4-di-t-amylphenoxy)acetamido)benzamido}-5-pyrazolone], as a ballasted magenta coupler, by 0.01 mole per mole of silver; and 2-(1-phenyl-5-tetrazolylthio)-6-[α-(2,4-di-t-amylphenoxy)acetamido]inddnone by 0.002 moles per mole of silver, The other procedures are carried out in the same way as for the seventh layer to obtain the ninth layer with 1.5 g silver and 1.65 g gelatin per $m^2$.

Tenth layer (a yellow-filtering layer):

A gelatin layer which contains dispersion of both yellow colloidal silver and 2.5-di-t-octyl-hydroquinone by 0.1 g silver and 1.2 g gelatin per $m^2$.

Eleventh layer (a layer masking in a blue-sensitizing layer):

A highly sensitive silver iodobromide gelatin solution which contains 6 mole % silver iodide and has 0.8μ average particle size is stabilized by adding a proper amount of 4-hydroxy-b-methyl-1,3,3a,7-tetrazaindene. An emulsified dispersion which contains the exemplary compound (2) by 0.25 moles per mole of silver is added to the silver halide emulsion. By coating the obtained mixture, the eleventh layer is formed with 0.2 g silver and 0.6 gelatin per $m^2$.

Twelfth layer (a blue-sensitive emulsion layer):

Instead of the exemplary compound (2), there is added α-[4-(1-benzyl-2-phenyl-3,5-dioxo-1,2,4-triazolidinyl)]-α-pivalyl-2-chloro-5-[γ-(2,4-di-t-amylphenoxy)butylamido]acetanilide. The twelfth layer is formed with 1.0 g silver and 3.0 g gelatin per $m^2$.

Thirteenth layer (a protective layer):

A gelatine layer which contains particles of polymethyl methacrylate with 1.5μ average particle size.

2-Hydroxy-4,6-dichloro-s-triazine sodium salt or bis-(vinyl sulfonyl)ethane as a gelatin film stiffner, and a certain surface active agent are added to the gelatine solution for every layer.

The photographic material thus obtained exhibits definite color images according to the same exposure and developiing treatments as in Example 1.

EXAMPLE 5

Instead of the third layer (the layer masking in a red-sensitizing layer of Example 4, there is adopted a layer which is formed by coating an emulsified dispersion that contains the exemplary compound (7) by 0.0017 moles, by 0.4 g gelatin per $m^2$. Instead of the seventh layer (the layer masking in a green-sensitizing layer) of Example 4, there is adopted a layer which is formed by coating an emulsified dispersion that contains the exemplary compound (1) by 0.0007 moles, by 0.4 g gelatin per $m^2$. Further, instead of the eleventh layer (the layer masking in a blue-sensitizing layer) of Example 4, there is adopted a layer which is formed by coating an emulsified dispersion that contains the exemplary compound (2) by 0.00046 moles, by 0.6 g gelatin per $m^2$. The other procedures are carried out according to the same way as in Example 1. The obtained sample exhibits definite color images according to the same exposure and developing treatments as in Example 1.

The present invention not only achieves its aimed objects but also makes it possible to provide much sharp color photographic materials with thickness-saving coated layers which lead to cost reductions in production and developing treatment.

What is claimed is:

1. In a photo-sensitive silver halide color photographic material having both (1) ballasted couplers combined with photo-sensitive silver halide emulsions and (2) colored compounds capable of reacting with the oxidized developing agent; said photo-sensitive silver halide color photographic material characterized in that (a) said colored compounds are compounds capable of diffusing at least 1μm in said photographic material during developing treatments thereof, (b) said colored compounds have their main absorption in the main absorption wavelength region of a dye produced by the reaction of said ballasted coupler with the oxidized color developing agent; (c) said colored compounds are contained either in the silver halide emulsion layers containing said ballasted couplers which produce said colored compounds, or in the silver halide emulsion layers having spectral sensitivity similar to said emulsion layers containing said ballasted couplers which produce said colored compounds, or in a photo-insensitive layer adjacent to said silver halide emulsion layers containing said ballasted couplers which produce said colored compounds; (d) said colored compounds are made colorless or diffused out from the photographic material by reaction with the oxidized color developing agent; and (e) said colored compounds are capable of remaining in the photographic material even after the developing treatments in an amount of at least 30% by weight of the amount added.

2. The material of claim 1 wherein said colored compounds are capable of diffusing at least five μm during said developing treatments.

3. The photo-sensitive silver halide color photographic material as claimed in claim 1, wherein said colored compound is used in an amount of from 0.01 to 1.00 mol per mol of a ballasted coupler.

4. The photo-sensitive silver halide color photographic material as claimed in claim 1, wherein said colored compounds are represented by the following Formula [I], A—Link—B Formula [I]

wherein

A is an organic residual group which react with oxidized developing agent and release quantitatively the component of the formula Link-B on reacting with the oxidized developing agent, Link is a linking group for spatially A and B, B is an organic residual group.

5. The photo-sensitive silver halide color photographic material as claimed in claim 4, wherein A in the Formula [I] is a coupler moiety of a component which reacts cross-oxidatively with the oxidized developing agent; Link in the Formula [I] represents —N=N—, —O—, —S—, —$NHSO_2$—, —$SO_2NH$—,

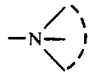

(i.e., a nitrogen-containing heterocyclic residual group),

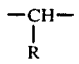

(wherein R is an alkyl or aryl group), or —CH=; and B represents an aryl, heterocyclic or dye residual group.

6. The photo-sensitive silver halide color photographic material as claimed in claim 1, wherein said colored compound is represented by the following Formula [II], Coup—$Link_2$—Ar Formula [II]

wherein Coup represents a coupler moiety; Ar represents an aryl group which is allowed to have a substituent, or a heterocyclic group which is allowed to have a substituent; and $Link_2$ represents —N=N— or —CH=.

7. The photo-sensitive silver halide color photographic material as claimed in claim 1, wherein said colored compound is represented by the following Formula [III], Coup—$Link_3$—Dye Formula [III]

wherein Coup- represents a coupler moiety; $Link_3$ is a linking group for spatially Coup and Dye; and Dye represents a dye moiety.

8. The photo-sensitive silver halide color photographic material as claimed in claim 1, wherein said colored compound is represented by the following Formula [IV], Wcoup—$Link_4$—Dye Formula [IV]

wherein Wcoup represents a white coupler moiety; $Link_4$ represents —O—, —S— or —$SO_2$—; and Dye represent a dye moiety.

9. The photo-sensitive silver halide color photographic material as claimed in claim 1, wherein said colored compound is represented by the following Formula [V], FUN—$Link_5$—Dye Formula [V]

wherein FUN represents a redox nucleus; $Link_5$ represents —$NHSO_2$— (where the nitrogen atom is combined with the FUN part), —O—, —$SO_2$ or —S—; and Dye represents a dye moiety.

10. The photo-sensitive silver halide color photographic material as claimed in claim 1, wherein said colored compound is contained in a photo-sensitive silver halide emulsion layer and/or in a other photographic component layer than said silver halide emulsion layer.

* * * * *